US008656613B2

(12) United States Patent
Stockbridge et al.

(10) Patent No.: US 8,656,613 B2
(45) Date of Patent: Feb. 25, 2014

(54) ARTICLE OF FOOTWEAR HAVING ARTICULATED SOLE MEMBER

(75) Inventors: Kurt Stockbridge, Palos Verdes Estates, CA (US); David Raysse, Los Angeles, CA (US); Kevin Chen, Dongguan (CN); Albert Teng-Lee, Los Angeles, CA (US)

(73) Assignee: Skechers U.S.A., Inc. II, Manhattan Beach, CA (US)

( * ) Notice: Subject to any disclaimer, the term of this patent is extended or adjusted under 35 U.S.C. 154(b) by 78 days.

(21) Appl. No.: 13/549,343

(22) Filed: Jul. 13, 2012

(65) Prior Publication Data

US 2014/0013624 A1 Jan. 16, 2014

(51) Int. Cl.

| | |
|---|---|
| ***A43B 1/10*** | (2006.01) |
| ***A43B 13/12*** | (2006.01) |
| ***A43B 13/14*** | (2006.01) |
| ***A43B 13/18*** | (2006.01) |
| ***A43B 13/00*** | (2006.01) |

(52) U.S. Cl.

CPC ..... *A43B 13/141* (2013.01); *A43B 13/181* (2013.01); *A43B 13/00* (2013.01)

USPC ..... 36/102; 36/103

(58) Field of Classification Search

CPC .. A43B 13/141; A43B 13/181; A43B 13/186; A43B 13/42; A43B 13/00

USPC ..... 36/103, 102, 28, 35 R, 31, 88, 11.5, 25 R

See application file for complete search history.

(56) References Cited

U.S. PATENT DOCUMENTS

| | | | | |
|---|---|---|---|---|
| 2,352,532 | A | 6/1944 | Ghez et al. | |
| 2,478,664 | A * | 8/1949 | Morrow et al. | 36/31 |
| 2,853,809 | A | 9/1958 | Bianchi | |
| 4,059,910 | A | 11/1977 | Bryden et al. | |
| 4,241,524 | A | 12/1980 | Sink | |
| 4,498,251 | A * | 2/1985 | Shin | 36/30 R |
| D288,027 | S | 2/1987 | Tonkel | |
| 4,779,361 | A | 10/1988 | Kinsaul | |
| 4,827,631 | A | 5/1989 | Thornton | |
| RE33,018 | E | 8/1989 | Ostrander | |
| 4,944,099 | A * | 7/1990 | Davis | 36/97 |
| 5,024,007 | A * | 6/1991 | DuFour | 36/127 |
| 5,044,096 | A | 9/1991 | Polegato | |
| 5,418,037 | A | 5/1995 | Maeder et al. | |
| 5,768,802 | A | 6/1998 | Bramani | |
| 6,354,020 | B1 | 3/2002 | Kimball et al. | |
| 6,412,196 | B1 * | 7/2002 | Gross | 36/102 |
| 6,634,121 | B2 * | 10/2003 | Sordi | 36/102 |
| 6,708,426 | B2 | 3/2004 | Erickson et al. | |
| 6,789,332 | B1 | 9/2004 | Scholz | |

(Continued)

FOREIGN PATENT DOCUMENTS

| | | |
|---|---|---|
| EP | 0 965 281 A2 | 12/1999 |
| EP | 0 965 281 A3 | 7/2001 |

*Primary Examiner* — Jila M Mohandesi

(74) *Attorney, Agent, or Firm* — Marshall A. Lemer; Marvin H. Kleinberg; Kleinberg & Lerner, LLP

(57) ABSTRACT

The invention is a shoe with an upper and a sole member. The sole member has multiple individual pieces connected to each other by connectors. The connectors are placed below the top surface of the sole member and above the bottom surface of the sole member. The connectors may connect the individual pieces of the sole member laterally and longitudinally.

5 Claims, 7 Drawing Sheets

(56) References Cited

U.S. PATENT DOCUMENTS

| | | | | |
|---|---|---|---|---|
| 6,836,979 | B2 | 1/2005 | Flavio et al. | |
| 6,915,594 | B2 * | 7/2005 | Kim | 36/29 |
| 6,915,596 | B2 | 7/2005 | Grove et al. | |
| 6,990,755 | B2 | 1/2006 | Hatfield et al. | |
| 7,168,190 | B1 | 1/2007 | Gillespie | |
| 7,171,767 | B2 | 2/2007 | Hatfield et al. | |
| 7,290,357 | B2 | 11/2007 | McDonald et al. | |
| 7,313,875 | B2 | 1/2008 | Morgan | |
| 7,392,605 | B2 | 7/2008 | Hatfield et al. | |
| 7,430,817 | B2 * | 10/2008 | Abadjian et al. | 36/29 |
| 7,444,763 | B2 | 11/2008 | Grove et al. | |
| 7,444,767 | B2 | 11/2008 | Kilgore et al. | |
| 7,555,851 | B2 * | 7/2009 | Hazenberg et al. | 36/102 |
| 7,565,755 | B2 * | 7/2009 | Tvoua et al. | 36/97 |
| 7,607,241 | B2 | 10/2009 | McDonald et al. | |
| 7,627,963 | B2 | 12/2009 | Kilgore | |
| 7,634,861 | B2 | 12/2009 | Kilgore | |
| 7,637,035 | B1 | 12/2009 | Gillespie | |
| 7,650,707 | B2 | 1/2010 | Campbell et al. | |
| 7,665,231 | B2 * | 2/2010 | Abadjian et al. | 36/29 |
| 7,694,435 | B1 * | 4/2010 | Kiser et al. | 36/11.5 |
| 7,707,748 | B2 | 5/2010 | Campbell | |
| 7,752,772 | B2 | 7/2010 | Hatfield et al. | |
| 7,814,686 | B2 * | 10/2010 | Becker et al. | 36/102 |
| 7,818,897 | B2 | 10/2010 | Geer | |
| 7,886,461 | B2 | 2/2011 | Sato | |
| 7,941,941 | B2 * | 5/2011 | Hazenberg et al. | 36/28 |
| 7,946,058 | B2 * | 5/2011 | Johnson et al. | 36/25 R |
| 8,020,320 | B2 | 9/2011 | Gillespie | |
| 8,458,928 | B2 * | 6/2013 | Becker et al. | 36/102 |
| 2002/0121031 | A1 * | 9/2002 | Smith et al. | 36/29 |
| 2003/0097767 | A1 | 5/2003 | Perkinson | |
| 2006/0061012 | A1 | 3/2006 | Hatfield et al. | |
| 2009/0235557 | A1 | 9/2009 | Christensen et al. | |
| 2010/0122476 | A1 | 5/2010 | Le et al. | |
| 2010/0192415 | A1 | 8/2010 | James | |
| 2010/0299965 | A1 | 12/2010 | Avar et al. | |
| 2010/0313447 | A1 | 12/2010 | Becker et al. | |
| 2011/0010964 | A1 | 1/2011 | Hardy et al. | |
| 2011/0016749 | A1 | 1/2011 | Callahan et al. | |
| 2011/0185590 | A1 * | 8/2011 | Nishiwaki et al. | 36/28 |
| 2011/0197469 | A1 * | 8/2011 | Nishiwaki et al. | 36/28 |
| 2011/0214313 | A1 | 9/2011 | James et al. | |
| 2011/0232130 | A1 | 9/2011 | Boudreau et al. | |
| 2012/0023779 | A1 | 2/2012 | Sato | |

* cited by examiner

ARTICLE OF FOOTWEAR HAVING ARTICULATED SOLE MEMBER

BACKGROUND OF THE INVENTION

1. Field of the Invention

The present invention relates to athletic shoes, in particular, a shoe that promotes the natural motion of the user's foot, thus providing movement efficiency and comfort for the user. This motion is achieved by a sole member that is comprised of individual pieces connected to each other, allowing a more natural motion of the foot.

2. Description of the Related Art

Shoes are designed for many purposes—from protection on the job, to performance during athletic activity, to everyday use. Increasingly, shoes have been designed to promote a more natural walking motion. Prior art shoes attempt to mimic barefoot movement by having specialized midsoles with a plurality of incisions or sipes, minimalist midsoles, outsole pads, etc.

Prior art shoes are generally comprised of sole members that have grooves and are made of materials that allow them to have a certain flexibility and thus articulation. In order for the sole members to have articulation, they generally have a plurality of sipes or incisions throughout the sole member. The incisions generally occur from the very bottom of the sole member to a point close to the top of the sole member. These sipes or incisions allow the sole member to flex.

However, all of these prior art shoes are only primarily flexible in a single direction. When one picks up a prior art shoe and holds the shoe with one hand on the bottom of the heel area and the other hand on the bottom of the forefoot area and pushes both ends upwardly and then towards each other, the shoe easily flexes in a downward projection, so that the upper surface is concave. This flexure is easily attained and both ends of the shoe may even touch. The gaps and/or sipes/incisions on the sole of the shoe will be exposed when this is done. Accordingly, the direction of the flexibility of the shoe is determined. The human foot however does not only move in that one direction, but also in the opposite direction. If one attempts to rotate the heel area downwardly and rotate the forefoot area downwardly, the shoe bends slightly, but has significant resistance to flexing in a downwardly concave direction. The prior art shoes are not designed for two way flexibility, but rather they are constructed in a manner that the flexure is made to occur in a single direction. Also, none of the prior art shoes allow for torsional flexibility.

The present invention aims to provide a way of assisting with and moving along with the natural motion of the user's foot, thus providing comfort and movement efficiency for the user. This motion is achieved by a unique sole member that is comprised of individual pieces connected by specifically placed connectors.

SUMMARY OF THE INVENTION

The present invention provides a shoe that assists with and moves naturally in tandem with the motion of the foot. The human foot is comprised of many individual bones, joints and muscles that are independent and move independently, yet are still in sync and connected with each other. This invention mimics such by having a sole member that is comprised of multiple individual pieces. The multiple individual pieces of the sole member are connected to each other through the use of connectors that are uniquely placed in relation to the individual pieces.

The shoe comprises an upper, and sole member. The shoe has a medial and a lateral side. The medial side is the side closest to the user's opposite leg (and the same side as the user's big toe) and the lateral side is the side that is opposite of the medial side, away from the user's other leg (and the same side as the user's small toe). The outsole may also be integrated into or be part of the midsole. In the preferred embodiment, the outsole is integrated with the midsole (so that there is no separate outsole) in order to create one unitary piece. In an alternative embodiment, pads may be placed on the bottom surface of the midsole. An integrated, unitary midsole and outsole or the combination of a separate midsole and a separate outsole is therefore described with reference to the surface that contacts the ground as the sole member. The upper, midsole and outsole each has a frontmost point and a rearmost point substantially opposite the frontmost point. As the terms imply, each frontmost point is closer to the user's toes than each rearmost point and correspondingly each rearmost point is closer to the user's heel than each frontmost point.

The shoe has a front tip that is located at the farthest forward point of the shoe when moving from the heel region to the forefoot region. The shoe has a rear tip that is located at the farthest rearward point of the shoe when moving from the forefoot region to the heel region. In a preferred embodiment, the front tip coincides with the frontmost point of the upper, the frontmost point of the midsole, or the frontmost point of the outsole while the rear tip coincides with the rearmost point of the upper, the rearmost point of the midsole, or the rearmost point of the outsole. In a preferred embodiment, the frontmost point of the upper, the frontmost point of the midsole, and the frontmost point of the outsole are all located relatively close to one another while the rearmost point of the upper, the rearmost point of the midsole, and the rearmost point of the outsole are all located relatively close to one another.

The upper and sole member each has a forefoot region. The forefoot region includes the region that extends substantially from the medial side to the lateral side at a location that begins in the vicinity of the front tip of the shoe and extends from there to a location that may be approximately three-eighths of the distance toward the rear tip of the shoe.

The upper and sole member each has a heel region. The heel region includes the region that extends substantially from the medial side to the lateral side at a location that begins in the vicinity of the rear tip of the shoe and extends from there to a location that may be approximately three-eighths of the distance toward the front tip of the shoe.

The upper and sole member each has a middle region. The middle region includes the region that extends substantially from the medial side to the lateral side at a location that extends approximately between the forefoot region and the heel region.

The sole member has a top surface and an opposite ground engaging bottom surface. When the shoe is in its normal, upright, unloaded position, the top surface is the surface that faces the shoe upper. The bottom surface is the surface that faces and engages the ground.

The sole member is comprised of multiple individual pieces. The pieces may comprise the sole member from the medial to lateral areas and/or the heel to toe areas. The individual pieces have a thickness that is measured from the top surface to the bottom surface. The individual pieces are connected to each other by connectors. At least one connector is required to connect two individual pieces to each other. As a result, an individual piece may have multiple connectors in order to connect it to multiple other individual pieces. For example, if the sole member is comprised of three individual pieces, an individual piece in the forefoot region, an individual piece in the middle region and an individual piece in the heel region, the individual piece in the forefoot region is connected to the individual piece in the middle region by at least a single connector. The individual piece in the middle region is connected by at least a single connector to the individual piece in the heel region. Accordingly, the three individual pieces are connected by at least two connectors, the individual piece in the middle region has two connectors attached to it connecting it to the individual pieces in the heel region and in the forefoot region.

The connectors are pieces of material, usually the same material as the sole member, that are placed below the top surface of the sole member and above the bottom surface of the sole member. The connectors have a thickness relative to the sole member. The connectors do not have a thickness that is greater than half of the thickness of the sole member. The thickness is typically less than half of the thickness of the sole member. The connectors may or may not be the full length or width of the individual pieces of the sole member. In the preferred embodiment, the connectors are less than the full length and width of the individual pieces of the sole member, thus causing gaps between the individual pieces of the sole member. In an alternative embodiment, the connectors may be the same length and width of the individual pieces of the sole member and therefore have no gaps. A connector connects individual pieces of the sole member at one point. The sole member, made of multiple pieces, requires multiple connectors to connect them and form the sole member. The connectors may be separate pieces or be molded into the sole member.

When viewing the preferred embodiment of the sole member from either the top surface or the bottom surface, gaps will be visible in between the individual sole pieces.

Due to the connectors and gaps, the sole member becomes very flexible. The present invention naturally guides the motion of the foot by allowing the sole member to conform to the natural movement of the foot. In the preferred embodiment, the sole member is flexible longitudinally, from the heel region to the toe region. The longitudinal flexibility may occur both upwards and downwards. The sole member is also flexible torsionally, i.e. the shoe may be twisted in the longitudinal direction. The sole member may also be flexible traversely, from the lateral to the medial sides. As a result, the shoe can move with the natural movement of the user's foot. This, in turn, imparts various benefits to the user such as increased movement efficiency and increased comfort.

BRIEF DESCRIPTION OF THE SEVERAL VIEWS OF THE DRAWINGS

By way of example only, selected embodiments and aspects of the present invention are described below. Each such description refers to a particular figure ("FIG.") which shows the described matter. All such figures are shown in drawings that accompany this specification are for the shoe to be worn on the right foot. Each such figure includes one or more reference numbers that identify one or more part(s) or element(s) of the invention.

DETAILED DESCRIPTION OF THE INVENTION

Figure 1:
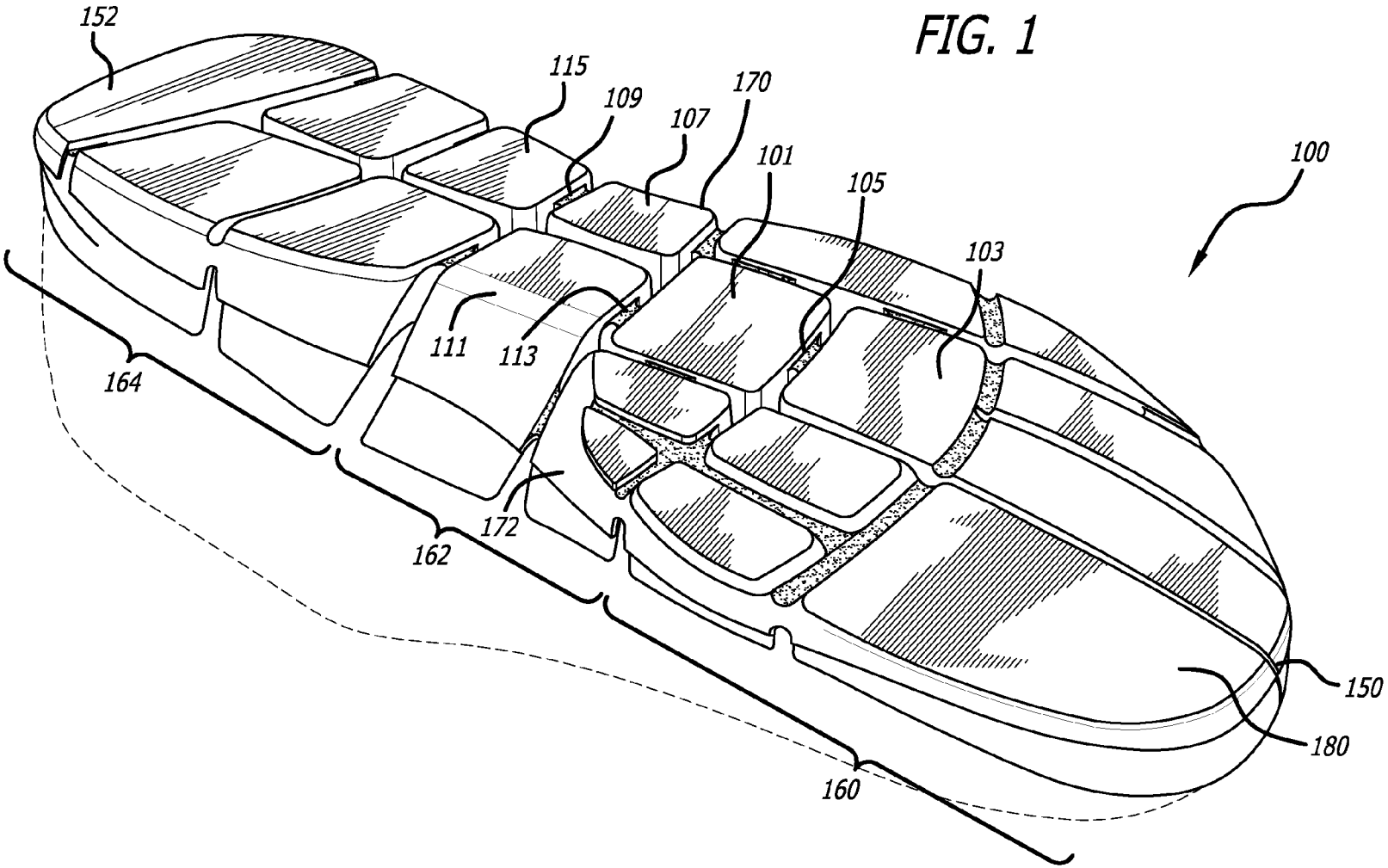
FIG. 1 is a bottom perspective view of an embodiment of the sole member of the right shoe.

The invention will now be described with reference to an embodiment shown in FIG. 1, which shows a bottom perspective view of the sole member 100 of the right shoe. The preferred embodiment of the shoe is comprised of an upper (not shown) and a unitary piece, referred to as a sole member 100. A sole member may also alternatively be comprised of a combined separate outsole and separate midsole.

The sole member 100 has a front tip 150 that is located at the farthest forward point of the shoe when moving from the heel region 164 to the forefoot region 160. The shoe has a rear tip 152 that is located at the farthest rearward point of the shoe when moving from the forefoot region 160 to the heel region 164. In the preferred embodiment, the front tip 150 coincides with the frontmost point of the sole member 100 while the rear tip 152 coincides with the rearmost point of the sole member 100.

The area within the brackets in the vicinity of the front tip 150 is referred to as the forefoot region 160. The area within the brackets in the vicinity of the rear tip 152 is referred to as the heel region 164. The area between the forefoot region 160 and heel region 164 within the brackets is referred to as the middle region 162.

The sole member 100 has a medial side 172 which is the side closest to the user's opposite leg and a lateral side 170 which is away from the user's other leg.

The sole member is comprised of individual pieces. A representative sole member piece in the forefoot region 160 is shown as 103. A representative sole member piece in the middle region 162 is shown as 101. The sole member pieces are connected by a connector 105. Another representative sole member piece in the middle region 162 is shown as 107. A representative sole member piece in the heel region 164 is shown as 115. The sole member pieces 115 and 107 are connected by a connector 109. Another representative sole member piece in the middle region 162 is shown as 111. It is connected to sole member piece 101 by connector 113.

As shown in FIG. 1, the connectors 105, 113 and 109 are below the bottom surface 180 of the sole member 100.

Figure 2:
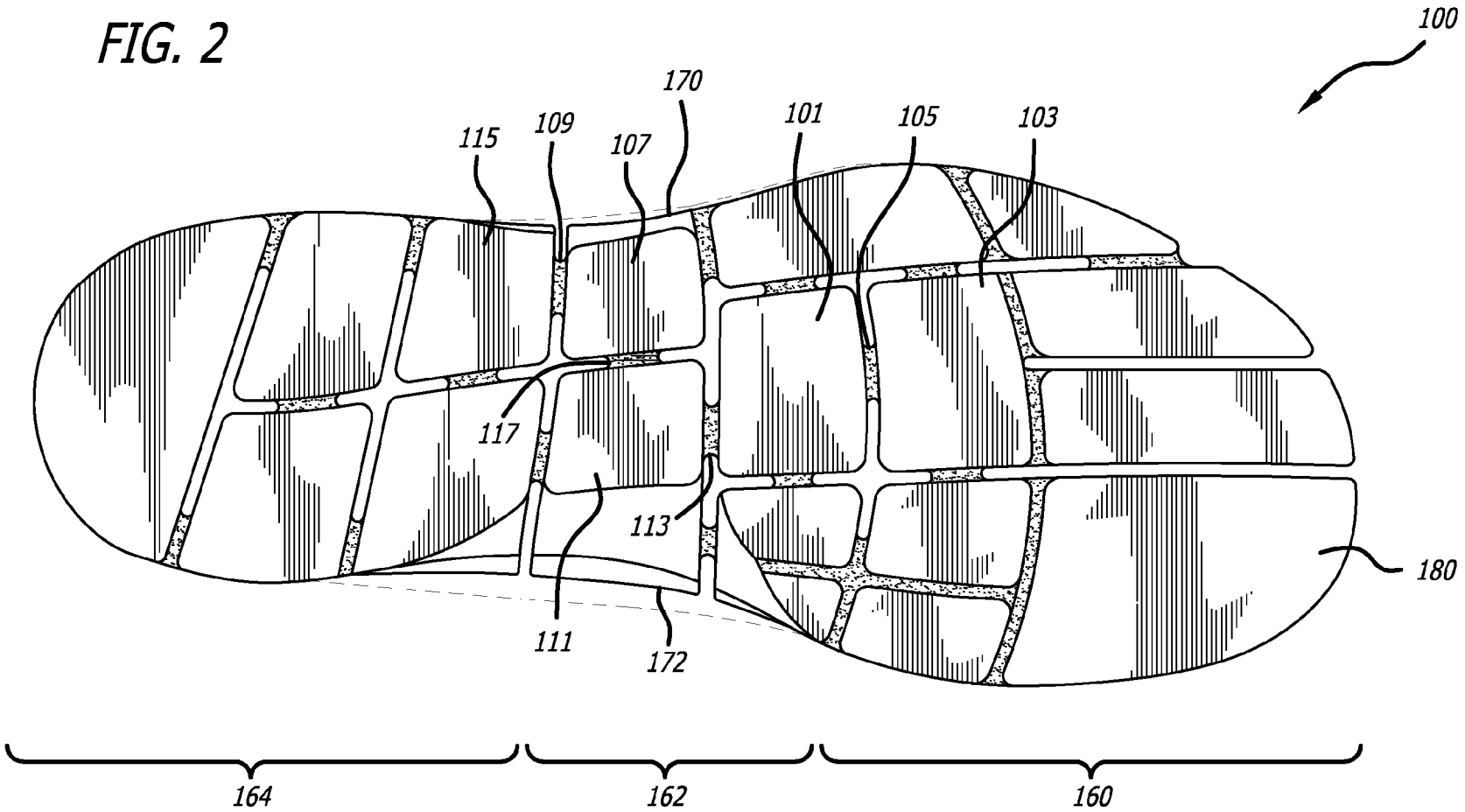
FIG. 2 is a plan view of the bottom surface of an embodiment of the sole member of the right shoe.

FIG. 2 is a plan view of the bottom surface 180 of an embodiment of the sole member 100 of the right shoe. The sole member is comprised of individual pieces. A representative sole member piece in the forefoot region 160 is shown as 103. A representative sole member piece in the middle region 162 is shown as 101. The sole member pieces are connected by a connector 105. Another representative sole member piece in the middle region 162 is shown as 107. A representative sole member piece in the heel region 164 is shown as 115. The sole member pieces 115 and 107 are connected by a connector 109. Another representative sole member piece in the middle region 162 is shown as 111. It is connected to sole member piece 101 by connector 113. Sole member piece 107 is connected to sole member piece 111 by connector 117. The connectors 105, 113, 117 and 109 are placed above the bottom surface 180.

Figure 3:
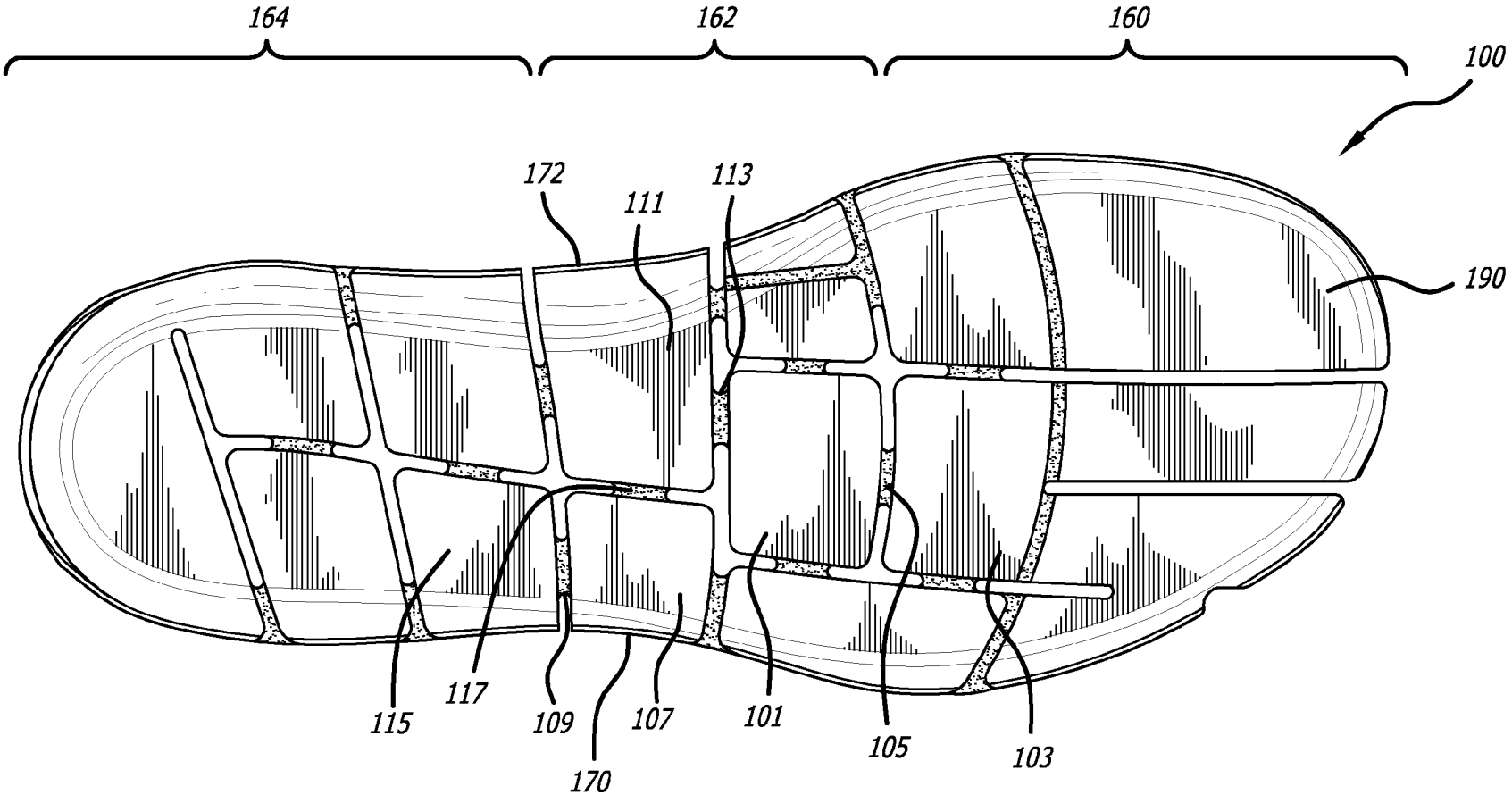
FIG. 3 is a plan view of the top surface of an embodiment of the sole member of the right shoe.

FIG. 3 is a plan view of the top surface 190 of an embodiment of the sole member 100 of the right shoe. The sole member is comprised of individual pieces. A representative sole member piece in the forefoot region 160 is shown as 103. A representative sole member piece in the middle region 162 is shown as 101. The sole member pieces 103 and 101 are connected by a connector 105. Another representative sole member piece in the middle region 162 is shown as 111. Another representative sole member piece in the middle region 162 is shown as 107. The sole member piece 111 and sole member piece 107 are connected by a connector 117. A representative sole member piece in the heel region 164 is shown as 115. Sole member piece 115 is connected to sole member piece 107 by a connector 109. Sole member piece 111 is connected to sole member piece 101 by a connector 113. The connectors 105, 109, 113 and 117 are placed below the top surface 190.

Figure 4:
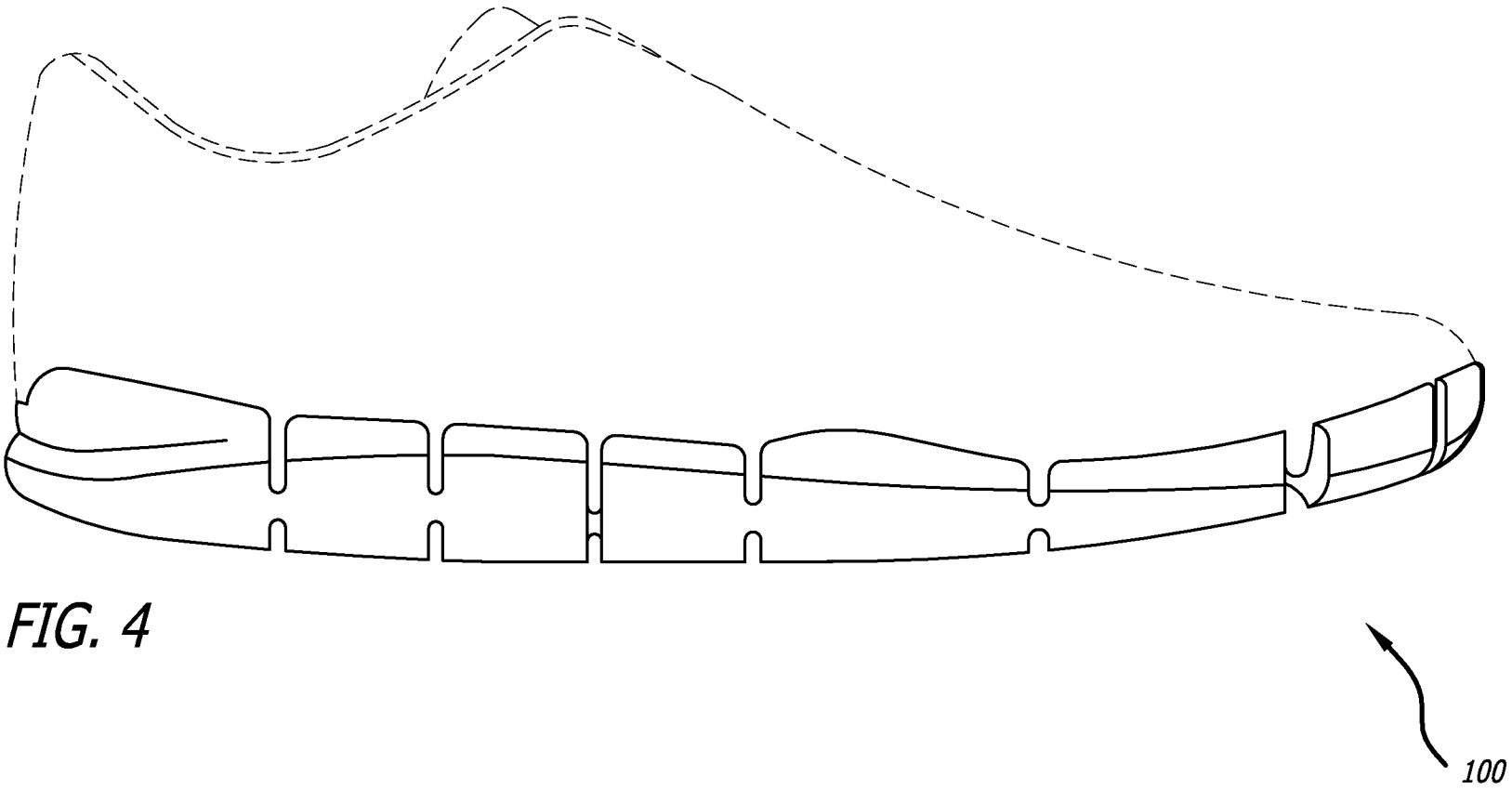
FIG. 4 is a lateral elevation view of an embodiment of the sole member of the right shoe.

FIG. 4 is a lateral elevation view of an embodiment of the sole member 100 of the right shoe.

Figure 5:
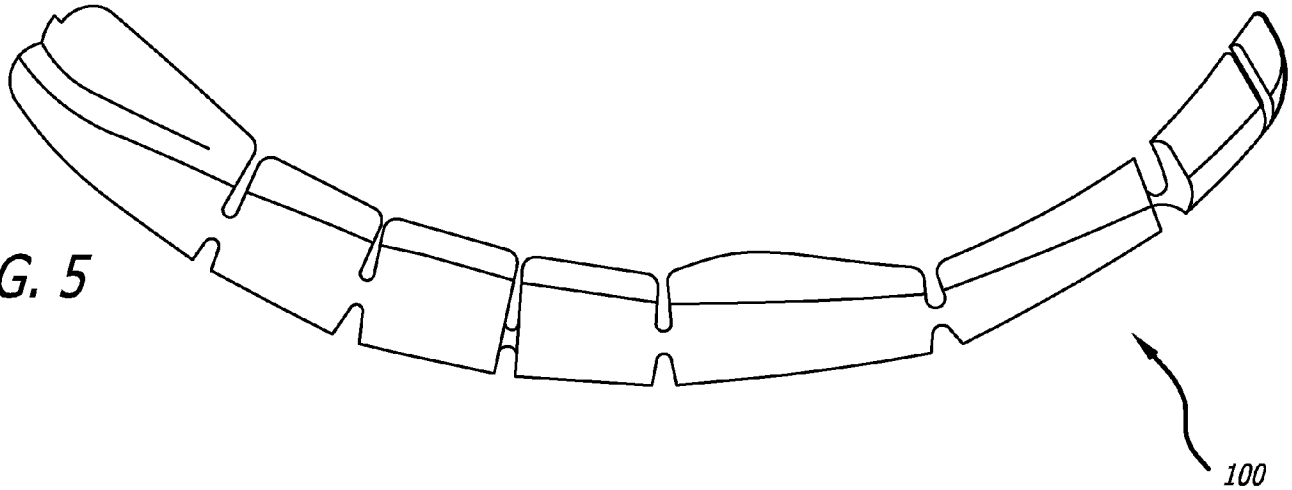
FIG. 5 is a lateral elevation view of an embodiment of the sole member of the right shoe being flexed.

FIG. 5 is a lateral elevation view of an embodiment of the sole member 100 of the right shoe, flexed upwardly. Due to the connectors, the sole member 100 is able to flex in an upwardly concave direction.

Figure 6:
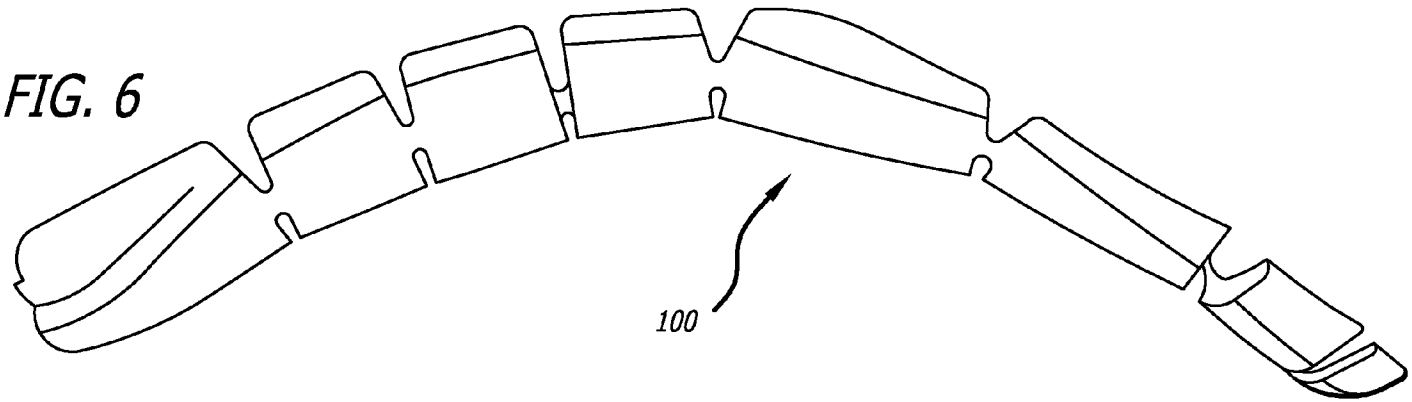
FIG. 6 is a lateral elevation view of an embodiment of the sole member of the right shoe being flexed.

FIG. 6 is a lateral elevation view of an embodiment of the sole member 100 of the right shoe, flexed downwardly. Due to the connectors, the sole member 100 is able to flex in a downwardly concave direction.

Figure 7:
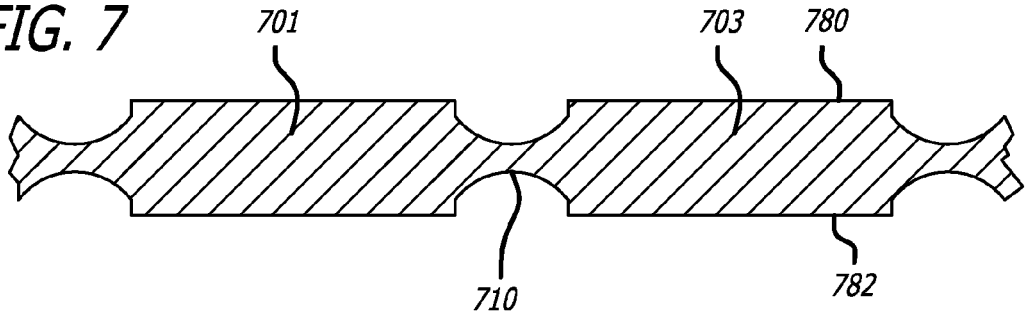
FIG. 7 is a cross section view of an alternative embodiment of the connectors and the individual pieces of the sole member.

FIG. 7 is a cross section view of an alternative embodiment of the connector 710 showing the individual pieces of the sole member 701 and 703 respectively. The connector 710 is positioned below the top surface 780 and above the bottom surface 782.

Figure 8:
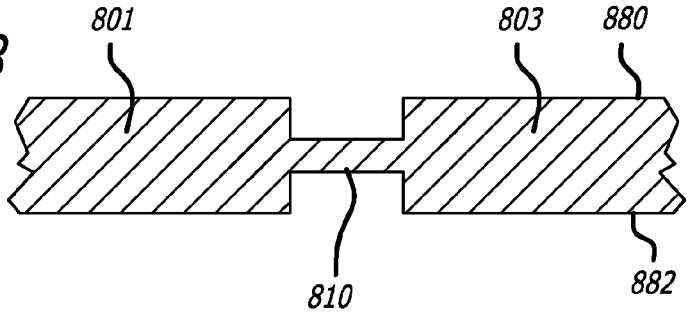
FIG. 8 is a cross section view of an alternative embodiment of the connector and the individual pieces of the sole member.

FIG. 8 is a cross section view of an alternative embodiment of the connector 810 showing the individual pieces of the sole member 801 and 803 respectively. The connector 810 is positioned below the top surface 880 and above the bottom surface 882.

Figure 9:
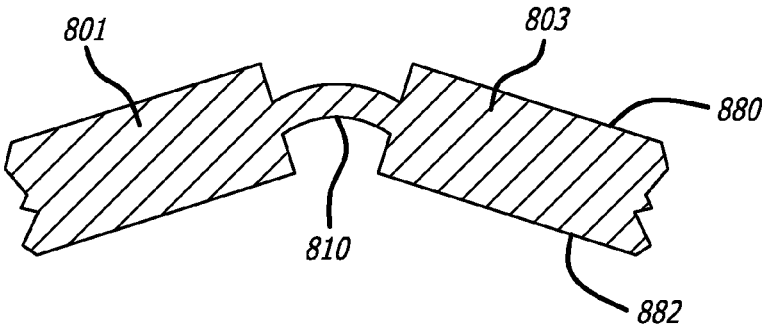
FIG. 9 is a cross section view of an alternative embodiment of the connector and the individual pieces of the sole member being flexed.

FIG. 9 shows the connector 810 of FIG. 8 flexed so that the pieces of the sole member are concave downwardly.

Figure 10:
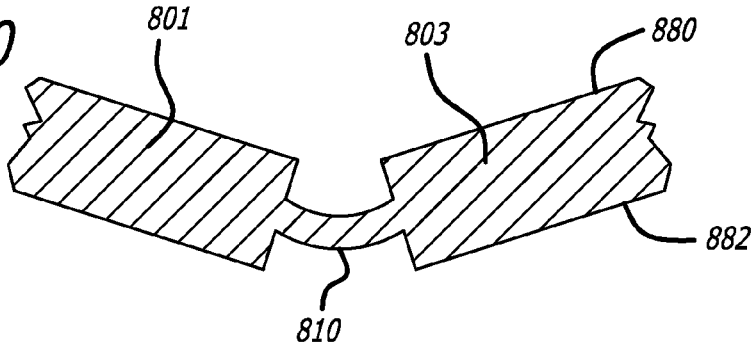
FIG. 10 is a cross section view of an alternative embodiment of the connector and the individual pieces of the sole member being flexed.

FIG. 10 shows the connector 810 of FIG. 8 flexed so that the pieces of the sole member are concave upwardly.

Figure 11:
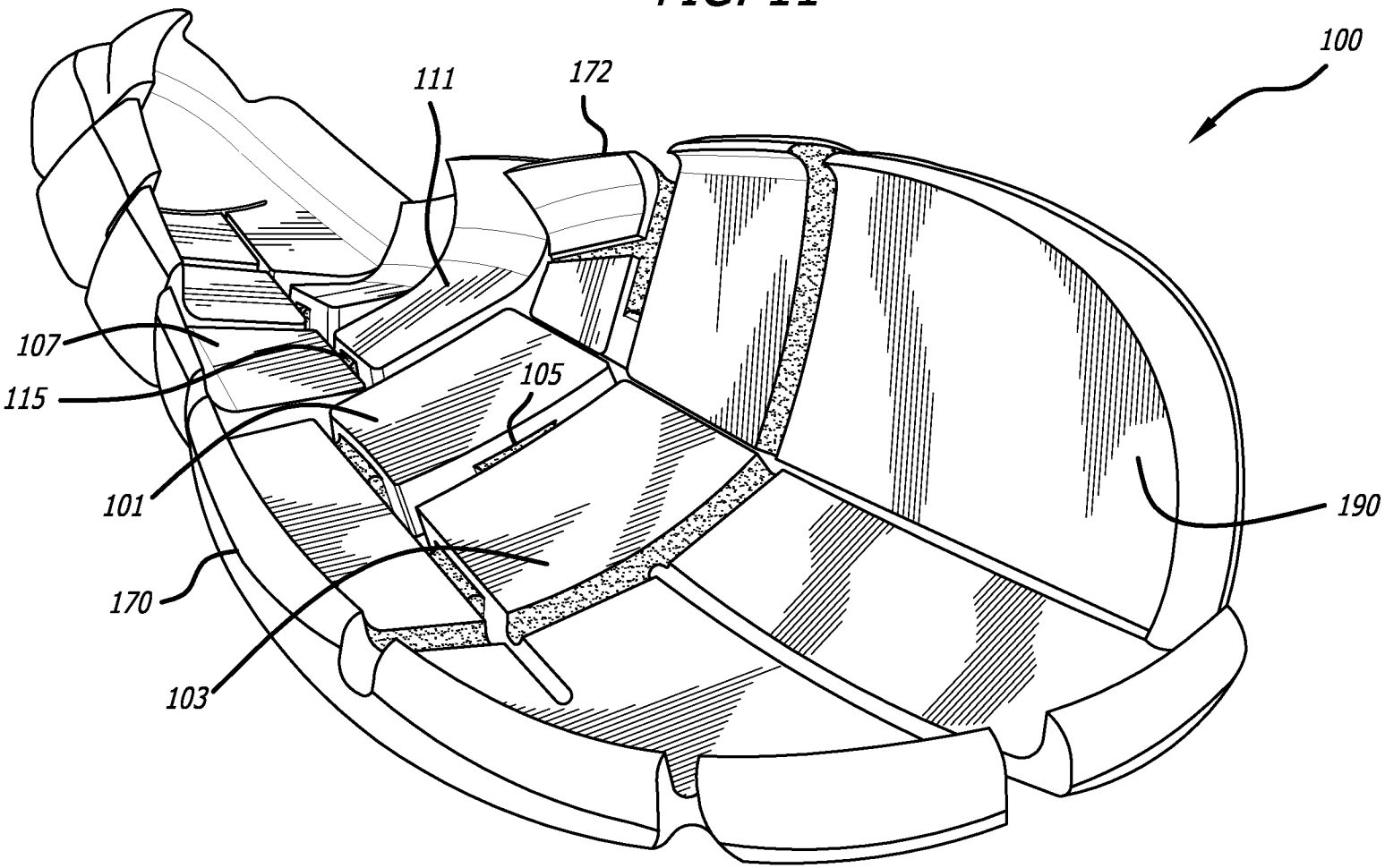
FIG. 11 is a perspective view of an embodiment of the sole member of the right shoe being flexed.

FIG. 11 is a top perspective view of an embodiment of the sole member of the right shoe being flexed. The figure shows the shoe being flexed torsionally in the longitudinal direction due to the construction of the connectors and individual sole pieces.

The sole member 100 and connectors are typically made from polyurethane, polyvinyl chloride, rubber, thermal plastic rubber or thermoplastic polyurethane. They may be separate pieces, or molded together.

Due to the unique connectors and individual pieces of the sole member the sole member is allowed to flex and naturally guide the movement of the foot, while also providing protection for the foot.

While the foregoing detailed description sets forth selected embodiments of a shoe in accordance with the present invention, the above description is illustrative only and not limiting of the disclosed invention. The claims that follow herein collectively cover the foregoing embodiments. The following claims further encompass additional embodiments that are within the scope and spirit of the present invention.

What is claimed is:

1. A shoe having an upper and a sole member, wherein said sole member comprises:

a forefoot region, a middle region, a heel region, a lateral side and medial side, a top surface and a bottom surface, wherein said sole member is divided into separate pieces, wherein said separate pieces are connected to each other by connectors, and further wherein at least one separate piece has a separate connector on each of its sides connecting said one separate piece to another separate piece, wherein said connectors are placed below the top surface and above the bottom surface, and wherein gaps exposed to the atmosphere exist around said connectors in between said pieces.

2. The shoe of claim 1 wherein at least one of said connectors does not extend the length of at least one of the separate pieces.

3. The shoe of claim 1 wherein at least one of said connectors extends the length of at least one of the separate pieces.

4. The shoe of claim 1 wherein said lateral side and medial side of said heel region contain at least two of the separate pieces.

5. The shoe of claim 1 in which the separate pieces and connectors are molded together to form a unitary sole member.

* * * * *